United States Patent [19]

Swett et al.

[11] Patent Number: 4,488,667

[45] Date of Patent: Dec. 18, 1984

[54] CONDIMENT SHAKER

[75] Inventors: James B. Swett, Altamonte Springs, Fla.; Erik Herlow, Copenhagen, Denmark

[73] Assignee: Dart Industries Inc., Northbrook, Ill.

[21] Appl. No.: 471,622

[22] Filed: Mar. 3, 1983

[51] Int. Cl.[3] ..... B67D 3/00

[52] U.S. Cl. ..... 222/485; 222/142.2; 222/142.7

[58] Field of Search ..... 222/478, 480, 481, 482, 222/484, 485, 486, 498, 196.1, 545, 556, 562, 153, 565, 142.2, 142.6, 142.7, 142.4, 142.8, 142.9; 220/339, 306, 254, 255

[56] References Cited

U.S. PATENT DOCUMENTS

| | | | |
|---|---|---|---|
| D. 54,244 | 12/1919 | Corey . | |
| D. 159,762 | 8/1950 | Touhey et al. | D44/6 |
| D. 173,652 | 12/1954 | Gerson | D44/22 |
| D. 200,270 | 2/1965 | Waterman | D58/26 |
| D. 248,204 | 6/1978 | Daenen | D7/54 |
| D. 254,238 | 2/1980 | Morin | D7/17 |
| 2,812,115 | 11/1957 | Pehr | 222/142.6 |
| 3,093,272 | 6/1963 | Esthus | 222/430 |
| 3,130,874 | 4/1964 | Bulmer | 222/142.9 X |
| 3,262,606 | 7/1966 | Waterman | 222/153 |
| 3,381,859 | 5/1968 | Yao et al. | 222/142.6 X |
| 3,412,890 | 11/1968 | Rich | 220/30 |
| 3,417,897 | 12/1968 | Johnson | 220/306 |
| 3,589,572 | 6/1971 | Hannon | 222/480 |
| 4,022,352 | 5/1977 | Pehr | 222/153 |

FOREIGN PATENT DOCUMENTS

| | | | |
|---|---|---|---|
| 962207 | 2/1975 | Canada | 222/142.9 |

*Primary Examiner*—Joseph J. Rolla
*Assistant Examiner*—Michael S. Huppert
*Attorney, Agent, or Firm*—John A. Doninger

[57] ABSTRACT

A container for condiments and the like comprising vertical side walls, a bottom wall integral with the side walls, and a removable top wall snap-fitted to the upper ends of the side walls and including multiple distinct dispensing ports. A cover, mountable over the top wall and sealing each of the ports therethrough, includes a movable component which, upon displacement, exposes one of the discharge ports. The cover is mountable in predetermined positions relative to the top wall for alignment of the movable component with any one of the discharge ports for a selective exposure thereof while the remaining ports are maintained sealed.

19 Claims, 8 Drawing Figures

FIG. 4
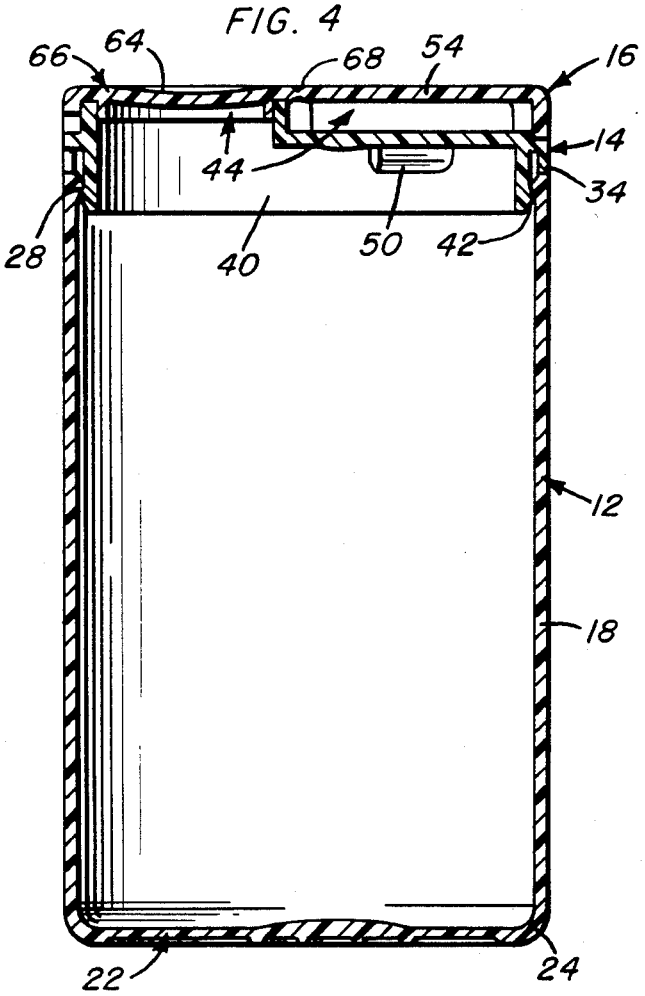
FIG. 6
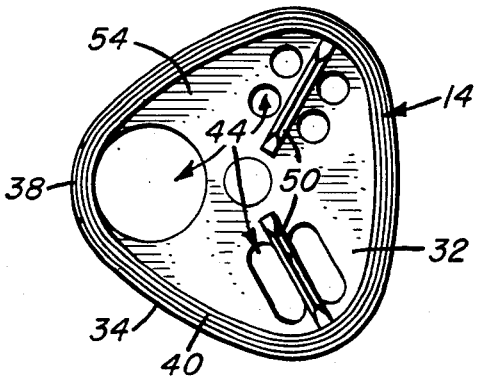
FIG. 7
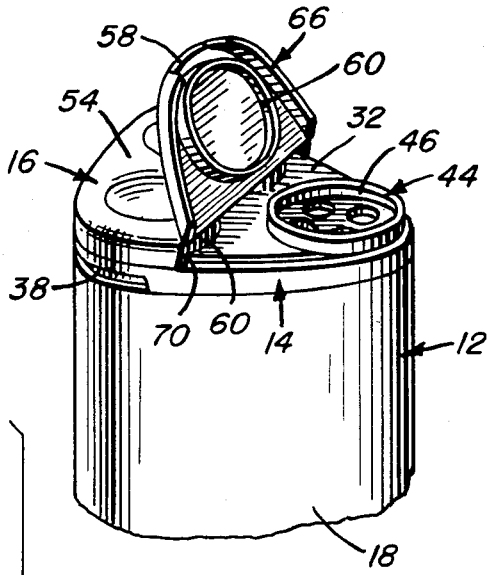
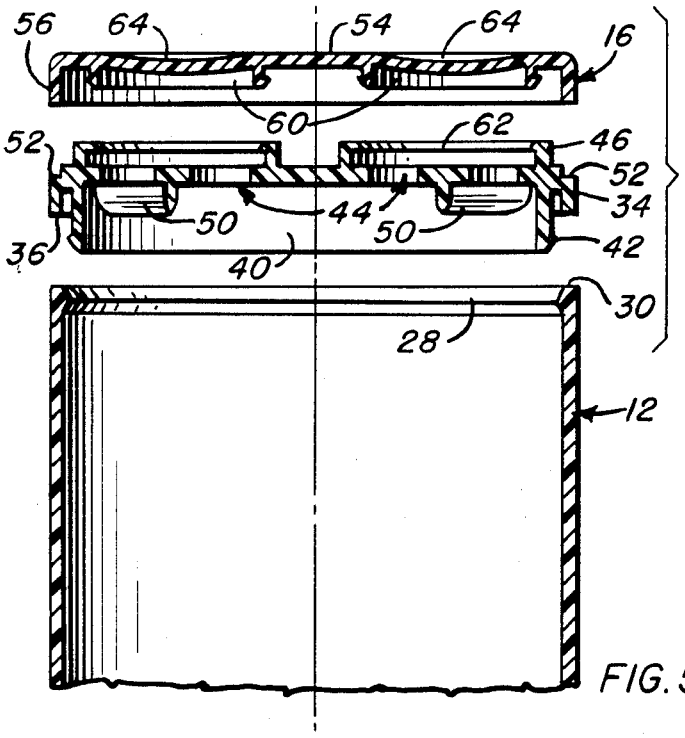
FIG. 5
FIG. 8
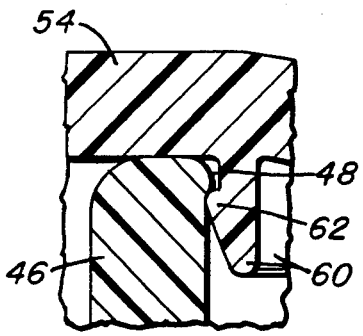

CONDIMENT SHAKER

BACKGROUND OF THE INVENTION

The invention herein is concerned with condiment shakers wherein provision is made for the selective dispensing of condiments through multiple distinct dispensing ports. Shakers of this general type are well known and basically fall into two categories, those incorporating multiple dispensing ports, each provided with its own individually manipulated cover component, and those wherein the opening of the ports requires a manipulation of the entire cover.

Examples of shakers provided with multiple discharge ports with separate manipulable cover components for each port will be noted in Waterman, U.S. Pat. No. Des. 200,270, issued Feb. 9, 1965, and Waterman, U.S. Pat. No. 3,262,606, issued July 26, 1966. In these patents, it will be appreciated that the cover consists of two searate manipulable components, each specifically associated with one of the ports and configured to conform solely to the associated port. Thus, the cover itself is a rather elaborate structure capable of being utilized only in one specific orientation relative to the top wall. In fact, it will be noted that the Waterman cover is permanently affixed to the top wall.

Another example of this general type of dispenser will be noted in Gerson, U.S. Pat. No. Des. 173,652, issued Dec. 14, 1954, wherein separate compartments are provided with open upper ends. The upper ends are sealed by an individual openable component specifically associated therewith. The dispensing ports in the side wall are always open, even with cover component in the installed position.

The patent to Yao et al, U.S. Pat. No. 3,381,859, issued May 7, 1968, presents another shaker wherein multiple compartments are provided, each with its own port and wherein all of the ports are simultaneously opened by a manipulation of the entire cover.

Esthus, U.S. Pat. No. 3,093,272, issued June 11, 1963, is directed to yet another form of shaker wherein manipulation of the entire cover is required not only to align with the individual ports, but also to effect an opening and closing of the individual ports. With shakers of this general type, manipulation of the cover relative to the container normally requires the use of two hands, one stabilizing the container and the other rotating the cover. Further, alignment with a specific port, from the closed position of the cover, normally requires what might be considered an excess rotation of the cover until the particular port is located.

SUMMARY OF THE INVENTION

The condiment shaker of the present invention utilizes a unique top wall and cover combination wherein one condiment can be selectively dispensed from any one of a plurality of distinct discharge ports utilizing a cover with a single movable portion or component. The movable portion, positioned relative to a single selected port, is movable between a first position sealing this port and a second position away from the port to enable discharge therethrough.

The cover is selectively positionable on the top wall for an alignment of the port exposing component or portion with any one of the ports for a selective exposure thereof, the cover sealing the remaining ports until such time as the cover is physically removed and repositioned for alignment of the movable portion with another one of the dispensing ports. In this manner, once a determination has been made as to the type of port desired for the condiment, the cover is mounted with the movable component or portion overlying the chosen port. The chosen port then can be selectively accessed at will through merely a manipulation of the single cover component with the remaining ports, at all times, being effectively sealed against any possibility of an accidental opening thereof. By the same token, should there be a conscious decision to utilize a different port, this can be quickly effected through a simple reorientation of the cover with the movable component aligned with the newly chosen port.

In providing a condiment shaker, as proposed above, it is no longer necessary to provide multiple movable components or portions on a cover to expose different ports. Further, once a particular port has been chosen, it is no longer necessary to manipulate the entire cover. To the contrary, an opening and closing of the chosen port need require only a relatively straightforward manipulation of the single movable component of the cover.

The specific features of the invention are herein embodied in a condiment shaker of triangular configuration, the body or container portion of the shaker being formed of equilateral walls with rounded apexes, and defining a single chamber. A closed bottom is provided integral with the side walls. The top wall, wherein three distinct discharge ports are defined, is mounted, through a snap-lock interfit, to the side walls. The cover, incorporating sealing means for all of the ports, is received over the top wall.

One of the port sealing means on the cover is incorporated in the portion or component thereof which hingedly mounts on the remainder of the cover whereby an exposure of the port aligned therewith can be easily effected by a mere upward pivoting of the cover portion. In this manner, once a decision has been made as to the type of port desired for a particular condiment, the cover can be mounted with the single manipulable portion of the cover positioned to selectively expose or conceal the chosen port. If use of a different port is dictated by, for example, the use of the shaker with a different type of condiment, the cover need merely be quickly manually repositioned to align the pivotal portion thereon to lie over and cooperate with the newly chosen port. Similarly, inasmuch as the top wall is snap-mounted in position, there also exists the possibility of providing for multiple interchangable top walls without the necessity of providing either, or both, a new container or a new cover.

Additional objects and advantages will become apparent from the following detailed description of the construction and manner of use of the invention.

BRIEF DESCRIPTION OF THE DRAWINGS

FIG. 4 is an enlarged cross-sectional view taken substantially on a plane passing along line 4—4 in FIG. 1;

FIG. 5 is a partial cross-sectional view, with the components exploded from each other, taken substantially on a plane passing along line 5—5 in FIG. 1;

FIG. 6 is a bottom plan view of the top wall of the shaker;

FIG. 7 is a partial perspective view of the upper portion of the container with the cover reoriented, relative to FIG. 2, for the exposure of a second one of the dispensing ports; and FIG. 8 is a sectional detail illustrating the snap-locking interengagement of a cover mounted sealing flange with a corresponding dispensing port collar.

DESCRIPTION OF THE PREFERRED EMBODIMENT

Figure 1:
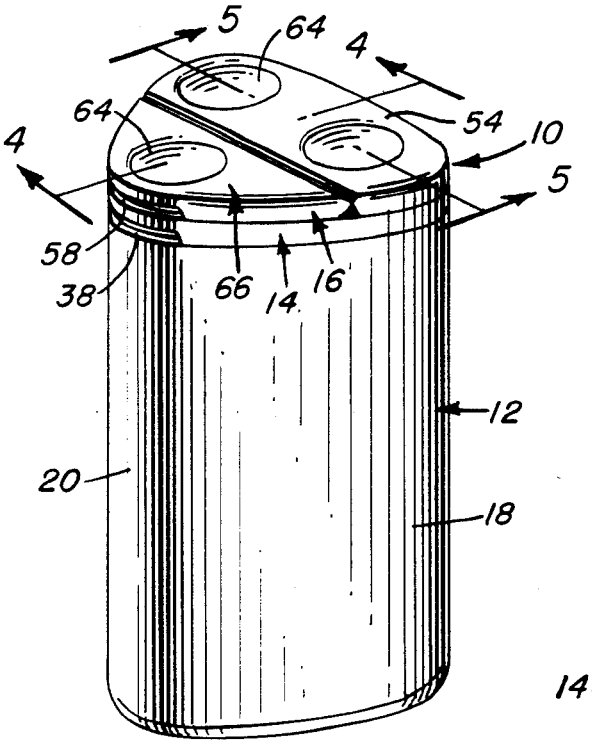
FIG. 1 is a perspecitve view of the condiment shaker of the present invention with the cover thereon in closed position.
Figure 3:
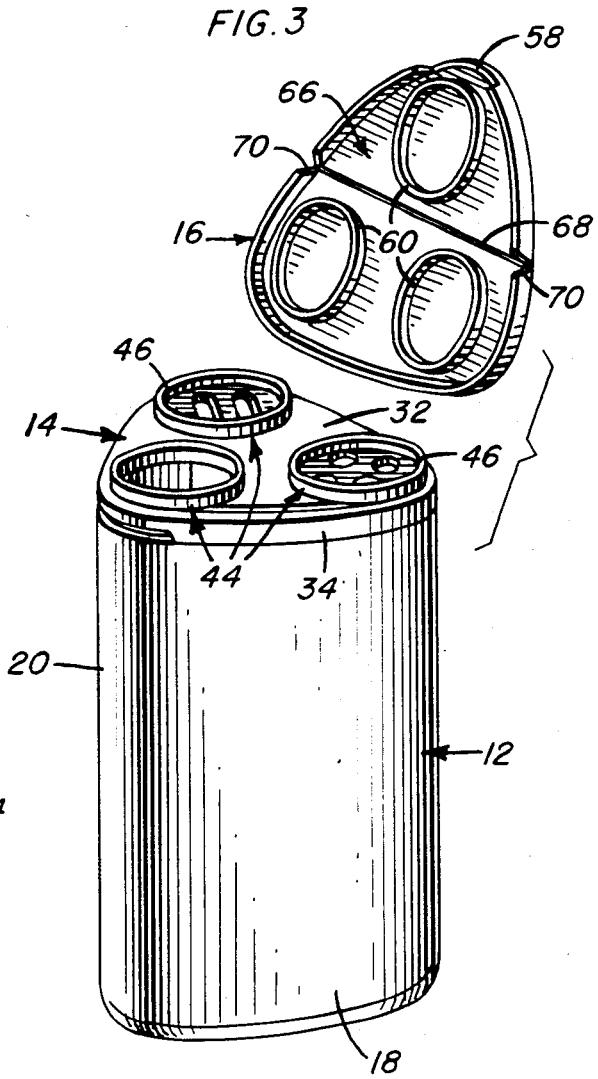
FIG. 3 is a perspective of the shaker with the entire cover removed therefrom.
Figure 2:
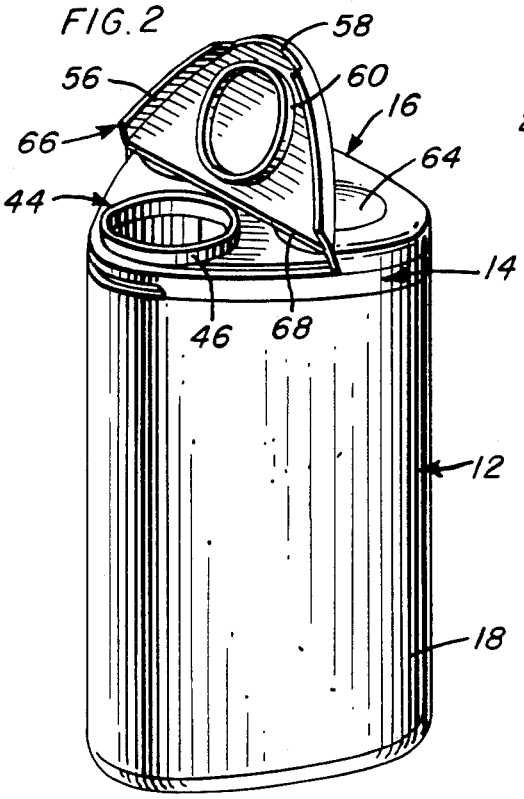
FIG. 2 is a perspective view similar to FIG. 1 with the cover in an open position exposing one of the dispensing ports while maintaining the remaining ports sealed.

Referring now more specifically to the drawings, the preferred embodiment of condiment shaker incorporating features of the present invention is designated by reference numeral 10. The shaker 10 consists of three interacting units a container body 12 defining a single internal compartment, a top wall 14 snap-locked to one end of the container body 12, and a cover 16 releasably and adjustably mountable in overlying relation to the top wall 14.

The container body 12 comprises vertically elongated walls 18 of an equal width and an equal annular orientation defining, in the illustrated embodiment, a body which, in cross-section, is an equilateral triangle. Each of the defined angles 20, between the equal width sides 18, is preferably of an arcuate configuration, avoiding sharp inner corners wherein condiments or the like may wedge.

Noting FIG. 4, the body 12 is formed with an integral base or bottom wall 22. The periphery of the bottom wall 22 is provided with a depending ridge 24 which slightly elevates the lower surface of the bottom wall for an accommodation of "molded-in" indicia used as a source designation or the like, without affecting the stability of the standing shaker.

The triangularly configured container body 12 terminates in an open upper end presenting a continuous upper edge 30. An integrally defined protuberance or rib 28 extends continuously about the inner surfaces of the wall immediately below the upper edge 30.

The top wall 14, molded as a one-piece assembly, includes a planar base panel 32 of a configuration conforming to the cross-sectional configuration of the body 12. The panel 32 includes a depending peripheral flange 34 terminating in a lower edge 36 which directly abuts against the upper edge 30 of the body 12 upon an alignment of the top wall 14 thereover. This peripheral flange 34 is relieved upward from the lower edge thereof, to define a gripping recess 38, preferably along one of the arcuate angles, to facilitate selective opening and/or removal of the top wall 14 as shall be described subsequently.

A second flange 40 integrally depends from the panel 32 in inwardly spaced parallel relation to the peripheral flange 34. This inner flange 40 is positioned for engagement within the upper portion of the body 12 upon a seating of the lower edge 36 of the lower flange 34 on the upper edge 30 of the open top of the body. Further, in order to provide for a positive yet releasable locking of the top wall 14 to the body 12, the lower portion of the flange 40, of a greater height than the outer flange 36, is provided with an outwardly directed continuous rib 42 which, upon a forceful downward movement of the top wall 14, locks immediately below the body rib 28. Both ribs 28 and 42 include tapered surfaces which, with an inherent degree of flexibility in the flange 42 and body 12, enables a snap-locking of the top wall 14 to the body 12. It is contemplated that the ribs 28 and 42 interact in a manner which provides a positive retention of the top wall 14 on the body 12 against any accidental release therefrom, while at the same time allowing for a manual removal of the top wall for purposes of replacement, cleaning, or the like.

The dispensing of the contents of the shaker is effected through dispensing ports 44, each located immediately inwardly of one of the apexes of the triangular wall 14. Each port 44 includes one or more dispensing openings through the top panel 32, and a surrounding upwardly projecting annular collar 46. In the illustrated embodiment, one port constitutes a single enlarged opening through the panel 32. A second port is defined by two elongated or slottype openings. The third port incorporates four circular openings. The collars of each port are of the same size and configuration. Further, each collar, as will be noted in the detail of FIG. 8, includes an inwardly directed lip 48.

The utilization of three distinctly formed ports provides for a ready accommodation of a wide range of condiments or foodstuffs to be discharged by shaking, sprinkling, pouring, or the like as required both by the foodstuff itself and the particular discharge desired. Further, due to the removable nature of the top wall, both the top wall and the body can be easily cleaned and filled. Additionally, the removable nature of the top wall lends itself to ready replacement in those instances where yet other forms of dispensing ports might be desired.

Noting FIGS. 5 and 6, it will be appreciated that an integrally formed bar depends from the under surface of the panel 32 and extends longitudinally across each of those ports 44 incorporating multiple openings. In this manner, each bar 50 specifically rigidifies and strengthens the narrow bridge of material of the panel 32 between the openings. At the same time, in order to facilitate flow through these relatively smaller openings, the bar 50 acts to "break-up" lumps of condiments or foodstuffs. This feature would be particularly desirable in connection with those condiments which have a tendancy to form lumps, such as sugar, grated cheese, and the like. As noted in the drawings, each bar 50 tapers, along the length thereof and downwardly from the under surface of the panel 32, to a narrow or knife edge, thus enhancing its ability to maintain a smooth flow through the immediate adjacent openings.

The top wall is completed by the provision of an upwardly and outwardly directed offset or shoulder 52 immediately above the outer depending flange 34 for seated reception of the cover as described hereinafter.

The cover 16, configured to correspond to the configuration of the top wall 14 and the container body 12, is, in the illustrated embodiment, triangular with arcuate apexes and includes a cover panel 54 with an integral depending peripheral flange 56. The flange is discontinuous for a portion of the length thereof, corresponding to one of the arcuate apexes, to define a gripping recess 58 similar to the recess 38 in the outer flange 34 of the top wall 14.

The cover also includes depending annular sealing flanges or rings 60, corresponding in number to the number of dispensing ports. The three annular flanges 60 illustrated are located immediately inward of the three apexes of the triangular cover, and align with the upwardly directed collars associated with the three discharge ports 44. Noting FIGS. 4 and 8 in particular, it will be appreciated that each depending annular flange 60 is adapted to closely engage and seal within a corresponding upwardly directed dispensing port collar 46. The engagement between each annular flange 60 and the associated collar 46 is enhanced by the provision of a continuous integral protuberance 62 peripherally about the outer surface of each of the annular flanges 60. These protuberances 62 engage or snap-fit beneath the inwardly directed lips 48 provided about the upper edge portion of each of the collars 46. When thus mounted, the cover is secured in overlying sealing relation to the top wall in a manner which, while preventing accidental dislocation therefrom, can be readily disengaged. It will also be appreciated that the peripheral flange 56 of the cover 16, upon a mounting of the cover 16 on the top wall 14, seats or is received on the annular upwardly and outwardly directed shoulder 52 of the top wall 14. In this manner, and as will be noted in FIGS. 1 and 4, upon an assembly of the three units of the shaker, the outer surfaces of the units are coplanar, providing a smooth continuous surface devoid of any projections.

As suggested in FIGS. 1 and 5, the upper surface of the cover panel 54 may be provided with three shallow depressions 64, one aligned with each depending annular flange 60 as a guide or finger-receiving area to ensure the application of pressure to the cover 16 directly over each port to achieve the desired cover-securing interlock noted in the detail of FIG. 8.

While the entire cover is removable as a unit, exposing all three discharge ports, the present invention contemplates the hinging of a specific portion 66 of the cover 16 for the selective exposure of one of the dispensing ports 44 while the remaining ports are effectively sealed. As noted, the selectively openable portion 66 of the cover 16 incorporates one of the apexes thereof, preferably the one with the manipulation-facilitating recess 58. This portion 66 is defined by an elongated hinge-forming line of weakness 68 extending transversely across the cover panel 54 perpendicular to an imaginary line bisecting the included apex, and terminates in opposed relieved areas 70 provided in the peripheral flange 56. The hinge 68, so positioned, is approximately equidistant from each of the annular sealing flanges 60, two of which are located to one side of the hinge 68, and one of which is located to the opposite side thereof and within the portion mounted for the selectively opening and closing of an aligned dispensing port.

In use, the cover 16 is aligned over the top wall 14 with the pivoted cover portion 66 overlying the discharge port which is to be utilized. This may be based on the particular condiment contained within the shaker and/or the specific type of discharge desired. With the cover 16 so positioned, the cover is secured to the top wall with the three depending annular flanges 60 snap-sealed into engagement with the corresponding upwardly projecting port collars 46. The hingedly mounted portion 66 of the cover 16 can then be easily manipulated, that is snapped open or closed as desired in connection with the dispensing of condiments through the selected discharge port. The remaining or fixed portion of the cover, at the same time, seals the remaining two ports against any accidental discharge therefrom. While the orientation of the hinge line 68 clearly defines the hingedly mounted portion 66 of the top cover 16, this portion can also be readily distinguished by the provision of the gripping recess 58 therein.

It is contemplated that the three units or components of the shaker of the invention, that is the body 12, the top wall 14 and the cover 16, all be molded of appropriate inert, nontoxic plastics.

The foregoing is illustrative of the principles of the invention and of a preferred embodiment. As other applications of the principles of the invention may occur to those skilled in the art, the invention is considered to encompass all suitable modifications and equivalents, within the scope of the invention as claimed.

We claim:

1. A shaker for holding and selectively dispensing a condiment or the like through any one of a plurality of discharge ports; said shaker comprising a container having bottom and side walls, and a top wall, said walls defining an internal compartment, said top wall having a plurality of discharge ports therethrough at spaced points thereabout, a cover removably receivable over said top wall, said cover, when received over said top wall, closing the plurality of discharge ports, said cover including a portion thereof alignable with one of said discharge ports and selectively movable relative to the remainder of the cover between a first closed position sealing the aligned discharge port and a second position enabling discharge through the aligned discharge port, said cover being receivable over said top wall in any of a plurality of positions, the selectively movable portion of the cover aligning with one of said discharge ports in any of said plurality of positions of said cover, said top wall is of an equilateral configuration, said cover being of a configuration complementary to the top wall for reception thereover, each discharge port includes an upwardly directed collar peripherally thereabout, said cover including sealing rings depending therefrom and receivable in sealing engagement, one with each of said discharge ports, one of said sealing rings depending from the selectively movable portion of the cover for sealing engagement with the aligned discharge port in the closed position of said movable portion.

2. The shaker of claim 1 wherein said sealing rings are received within the collars peripherally about the discharge ports, and means releasably interlocking each received ring and the corresponding collar.

3. The shaker of claim 2 wherein the means releasably interlocking each ring and collar comprises complementary projections on each collar and the associated ring, the projections selectively engaging beyond each other upon the forceable introduction of each ring within the associated collar.

4. The shaker of claim 3 wherein said side walls include upper edges defining an open upper end for the container, said top wall being removably received within said open end, and means releasably interlocking said top wall with the side walls at said upper end.

5. The shaker of claim 4 wherein the means interlocking the top wall and the side walls includes inwardly projecting rib means on said side walls immediately below the open upper end thereof, first flange means depending from said top wall for engagement with and along the upper edges of the side walls, and second flange means depending from said top wall inward from said first flange means for reception within the upper portion of the side walls, said second flange means including outwardly directed rib means selectively snap-engaged beneath the side wall rib means.

6. The shaker of claim 5 wherein said cover includes a depression overlying each of said sealing rings and providing location means for enabling the application of a closing force to the cover directly aligned with the sealing rings.

7. The shaker of claim 3 wherein said cover includes a depression overlying each of said sealing rings and providing location means for enabling the application of a closing force to the cover directly aligned with the sealing rings.

8. The shaker of claim 5 wherein three side walls are utilized, said side walls defining an equilateral triangular cross-section, said top wall being of a similar triangular configuration and defining three apexes.

9. The shaker of claim 8 wherein each discharge port is located immediately inward of one of the top wall apexes.

10. The shaker of claim 9 wherein three discharge ports are provided through the top wall.

11. The shaker of claim 10 wherein said cover is of a triangular configuration having three apexes, said selectively movable portion of the cover being defined to include one of the cover apexes.

12. The shaker of claim 11 wherein the selectively movable portion of the cover is defined by a hinge line inwardly spaced from said one of the cover apexes and traversing the cover in generally perpendicular relation to an imaginary line bisecting said one of said cover apexes.

13. A shaker for holding and selectively dispensing a condiment or the like through any one of a plurality of discharge ports; and shaker comprising a container having bottom and side walls, and a top wall, said walls defining an internal compartment, said top wall having a plurality of discharge ports therethrough at spaced points thereabout, a cover removably receivable over said top wall, said cover, when received over said top wall, closing the plurality of discharge ports, said cover including a portion thereof alignable with one of said discharge ports and selective movable relative to the remainder of the cover between a first closed position sealing the aligned discharge port and a second position enabling discharge through the aligned discharge port, said cover being receivable over said top wall in any of a plurality of positions, the selectively movable portion of the cover aligning with one of said discharge ports in any of said plurality of positions of said cover, said container having three side walls, said side walls defining an equilateral triangular cross-section, said top wall and said cover being of a similar triangular configuration and defining three apexes, three discharge ports are provided through the top wall, said selectively movable portion of the cover includes one of the cover apexes and is defined by a hinge line traversing the entire cover and extending generally perpendicular to an imaginary line bisecting said one of said cover apexes.

14. A shaker for holding and selectively dispensing a condiment or the like through any one of a plurality of discharge ports; said shaker comprising a container having bottom and side walls, and a top wall having a peripheral shoulder thereon, said walls defining an internal compartment, said top wall having a plurality of discharge ports each of which is defined by an upwardly directed collar, a cover removably receivable over and engaging with said peripheral shoulder of said top wall in any of a plurality of positions, said cover including a like plurality of sealing rings adapted to mate with said collars and close said discharge ports, and said cover having a portion thereof selectively pivotable relative to the remainder of the cover between a first closed position wherein one of said sealing rings mates with one of said collars to close the discharge port and a second position wherein the discharge port is open.

15. The shaker of claim 14 wherein said sealing rings are received within the collars peripherally about the discharge ports, and means releasably interlocking each received ring and the corresponding collar.

16. The shaker of claim 15 wherein the means releasably interlocking each ring and collar comprises complementary projections on each collar and the associated ring, the projections selectively engaging beyond each other upon the forceable introduction of each ring within the associated collar.

17. The shaker of claim 16 wherein said side walls include upper edges defining an open upper end for the container, said top wall being removably received within said open end, and means releasably interlocking said top wall with the side walls at said upper end.

18. The shaker of claim 14 wherein said cover is of a triangular configuration having three apexes, said selectively pivotable portion of the cover being defined to include one of the cover apexes.

19. The shaker of claim 18 wherein the selectively pivotable portion of the cover is defined by a hinge line inwardly spaced from said one of the cover apexes and traversing the cover in generally perpendicular relation to an imaginary line bisecting said one of said cover apexes.

* * * * *